US008238989B2

(12) United States Patent
Rowell

(10) Patent No.: US 8,238,989 B2
(45) Date of Patent: Aug. 7, 2012

(54) RF COMPONENT WITH A SUPERCONDUCTING AREA HAVING HIGHER CURRENT DENSITY THAN A NON-SUPERCONDUCTING AREA

(75) Inventor: Corbett R. Rowell, Mongkok (CN)

(73) Assignee: Hong Kong Applied Science and Technology Research Institute Co., Ltd., Hong Kong (CN)

( * ) Notice: Subject to any disclaimer, the term of this patent is extended or adjusted under 35 U.S.C. 154(b) by 975 days.

(21) Appl. No.: 12/200,902

(22) Filed: Aug. 28, 2008

(65) Prior Publication Data

US 2010/0056379 A1 Mar. 4, 2010

(51) Int. Cl.
*H01B 12/02* (2006.01)

(52) U.S. Cl. ..... 505/201; 505/210; 333/99 S; 343/702

(58) Field of Classification Search ..... 333/99 S; 505/201, 210; 343/702
See application file for complete search history.

(56) References Cited

U.S. PATENT DOCUMENTS

| | | | | |
|---|---|---|---|---|
| 5,151,709 | A | 9/1992 | Balzano et al. | |
| 5,661,400 | A | 8/1997 | Plies et al. | |
| 6,041,245 | A * | 3/2000 | Mansour | 505/210 |
| 6,470,198 | B1 * | 10/2002 | Kintaka et al. | 505/210 |
| 6,686,811 | B2 | 2/2004 | Hey-Shipton | |
| 6,933,748 | B2 | 8/2005 | Hey-Shipton | |
| 2002/0151331 | A1 | 10/2002 | Abdelmonem et al. | |
| 2008/0032895 | A1 | 2/2008 | Hammond et al. | |

FOREIGN PATENT DOCUMENTS

| | | | |
|---|---|---|---|
| JP | 0005602 | * | 1/1990 |
| JP | 0017701 | * | 1/1990 |

OTHER PUBLICATIONS

Patent Abstracts of Japan; Title: Ceramic Superconductive Material; Inventor: Koichi et al; Publication No. 63299010; Publication Date: Jun. 12, 1988.*

* cited by examiner

*Primary Examiner* — Benny Lee
(74) *Attorney, Agent, or Firm* — Fulbright & Jaworski L.L.P.

(57) ABSTRACT

A Radio Frequency (RF) component comprising a non-superconducting material, and a superconducting material, wherein the superconducting material is disposed in one or more areas of the RF component such that the areas with superconducting material conduct greater current density than do areas with the non-superconducting material.

24 Claims, 4 Drawing Sheets

RF COMPONENT WITH A SUPERCONDUCTING AREA HAVING HIGHER CURRENT DENSITY THAN A NON-SUPERCONDUCTING AREA

TECHNICAL FIELD

The present description relates, in general, to RF components employing superconducting materials and, more specifically, to RF components employing mixed materials.

BACKGROUND

Radio Frequency (RF) circuits/components (e.g., antennas) are generally made of copper. Copper is inexpensive, it is plentiful, and it has fairly high conductivity and very low resistivity. In the antenna context, resistivity keeps the energy from being radiated out. The energy gets turned into heat instead, thereby lowering the efficiency of the antenna.

Copper is useful for most components where the component size is roughly the size of the natural resonance, which usually occurs at $\lambda/4$ or $\lambda/2$ or $\lambda$, where $\lambda$ is a wavelength. However, as the size of a component decreases relative to its operating wavelength, resistivity increases greatly. Examples of such components include loaded antennas, such as helix antennas, which decrease the size of an antenna usually to a third or less of its resonant length.

Superconducting materials do not have resistivity (at least when the temperature of the materials drops below critical temperature, $T_c$). In theory, a superconducting component can provide a much higher efficiency than an all-copper component. Superconducting materials have detriments that make them less than optimal for some deployments. First, they are very expensive. Second, they require a cryogen to provide cooling down to $T_c$, e.g., $T_c$ of some high-temperature superconductors is 92° K, and is lower for other superconductors, such as low-temperature superconductors. Third, superconducting materials are typically brittle, and it is difficult to shape superconducting materials into anything other than two-dimensional (2D) thin, flat tape or wire.

Currently there are prior art RF systems that employ superconducting materials. One example is solutions that make an entire system out of superconducting materials. Such systems are usually constricted to a 2D surface, take up a large space, and are expensive. Recently, as wireless base stations become more complicated, engineers are facing heat issues, particularly with power amplifiers and filters. In the commercial area people are beginning to use filters made of superconducting materials for outdoor base stations, and the cost goes up because of the material and the cryogenic cooling system. However, the space requirements are reduced significantly, which can offset the increased cost of manufacture. One base station system uses filters that are completely made of superconducting material.

Another prior art system includes a filter bank with some filters made of superconducting materials and other filters made of non-superconducting materials. Yet another prior art system includes a copper antenna embedded in a superconducting sphere or column to improve the antenna fields after they have left the antenna and before they go out into free space, similar to a lens effect. However, these prior art systems that employ whole circuits or components made entirely of superconducting materials are hard to build because of the brittleness of superconducting materials, and are expensive to manufacture because of the high cost of superconducting materials.

SUMMARY

Various embodiments of the invention are directed to systems and methods including RF circuits that employ both non-superconducting and superconducting materials within a given, discrete component. In one example, an antenna element includes superconducting material in portions that have a high current density while other portions are made of non-superconducting material. An example method includes designing an RF circuit/component, ascertaining the current densities within the circuit/component, and replacing one more portions that have high current densities with superconducting material.

Various embodiments of the invention provide advantages over the prior art. For instance, some embodiments allow the same design freedom that is had with copper in making complex shapes and three-dimensional (3D) shapes, while at the same time providing performance characteristics of superconducting material.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawings, in which.

DETAILED DESCRIPTION

Figure 1:
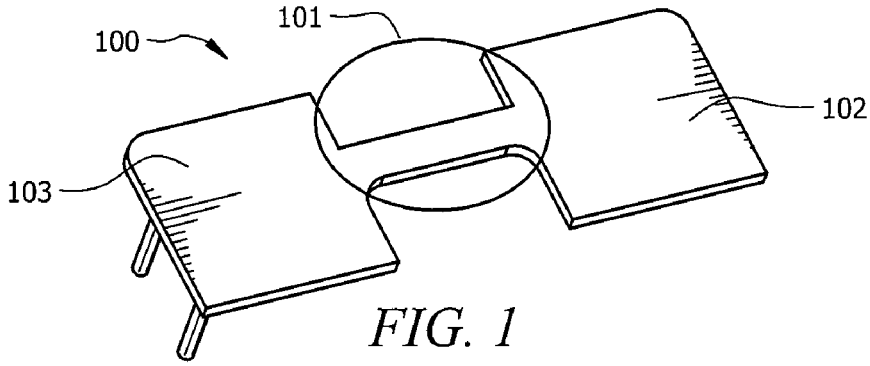
FIG. 1 is an illustration of an exemplary system adapted according to one embodiment of the invention.

FIG. 1 is an illustration of exemplary system 100 adapted according to one embodiment of the invention. System 100 includes a Planar Inverted F Antenna (PIFA) element with sections 101, 102, and 103. Section 101, in this example, has the highest current density during operation of any of the three sections 101, 102, and 103. Furthermore, section 101 is constructed of superconducting material, whereas sections 102 and 103 are constructed of non-superconducting material. By replacing non-superconducting material with superconducting material in section 101, system 100 achieves greater efficiency, due to having less resistivity, than would a similarly shaped design using only non-superconducting material.

Figure 2:
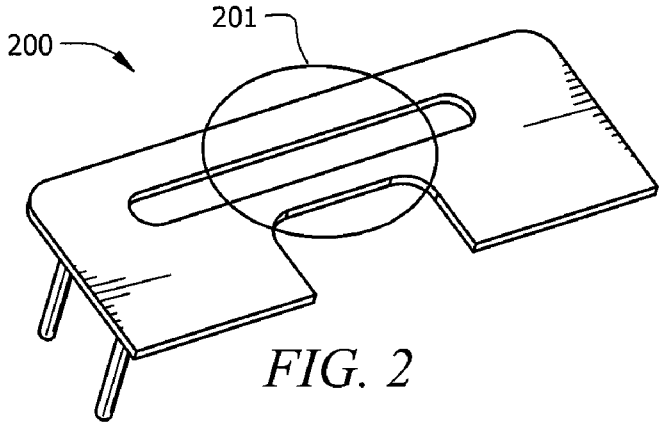
FIG. 2 shows an exemplary system adapted according to one embodiment of the invention.
Figure 3:
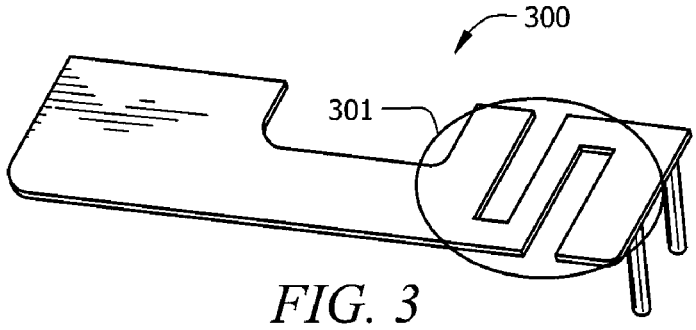
FIG. 3 shows an exemplary system adapted according to one embodiment of the invention.

FIGS. 2 and 3 illustrate two other exemplary PIFA embodiments according to the principle described herein. FIG. 2 shows exemplary system 200 adapted according to one embodiment of the invention. System 200 is a PIFA element with a slot, where section 201 (the portion surrounding the slot) includes superconducting material. FIG. 3 shows exemplary system 300 adapted according to one embodiment of the invention. System 300 is a PIFA element with a meander line, where section 301 includes superconducting material. The scope of the invention is not limited to PIFA antenna elements and, in fact, is not limited to antennas at all. Embodiments of the invention can be adapted for use in any RF component, such as antennas, filters, amplifiers, circulators, dividers, couplers, transmission lines, and the like, such as may operate within the frequency range of one megahertz to ten terahertz. Various embodiments can take advantage of any superconducting material, as well as any conducting material. For example, some embodiments use Yttrium Barium Copper Oxide (YBCO), which is basically a ceramic with a very high critical temperature (at least for superconductors) at 92° K. The same or different embodiments can use copper as a conducting material because it is easily soldered, it deforms in many different patterns, and it has relatively good electrical properties for use in RF components.

Figure 4:
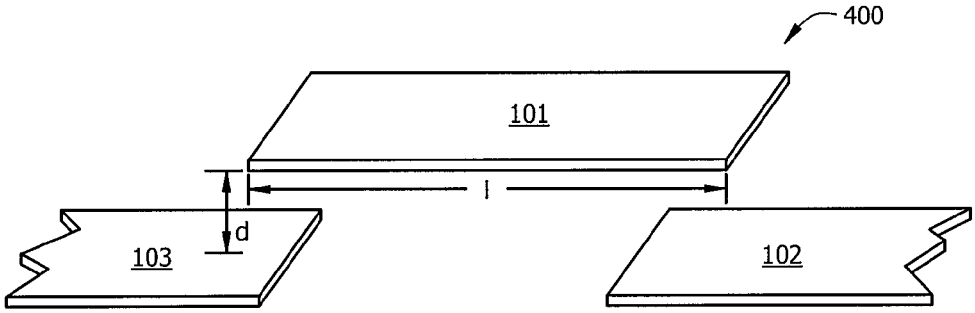
FIG. 4 is an illustration of an exemplary coupling scenario according to one embodiment of the invention.

FIG. 4 is an illustration of exemplary coupling scenario 400 according to one embodiment of the invention. FIG. 4 shows a close-up view of the superconducting material of section 101 (FIG. 1) and how it is connected to the non-superconducting material of sections 102 and 103. Various embodiments of the invention couple the superconducting material to the non-superconducting material in a way that provides for the best possible matching. In order to achieve matching, one option is a capacitive coupling. A capacitive coupling technique includes placing the superconducting material so that it overlaps the non-superconducting material by some margin, usually of 2-10% of the surface area of the superconducting material. In this manner, matching is controlled by the amount that the surface area is overlapped between the non-superconducting material and the superconducting material. Such a technique is shown in FIG. 4, where section 101 overlaps both sections 102 and 103. For example, if "1" is 50 mm, then the overlap with 103 is about 1-5 mm, which varies depending on resonant frequency, geometry, materials, and the like. Matching is also controlled by distance "d," which can vary among embodiments. In some cases, ultrasonic welding can be used to mechanically adhere the materials together, thereby shrinking distance "d" to be very small.

Figure 5:
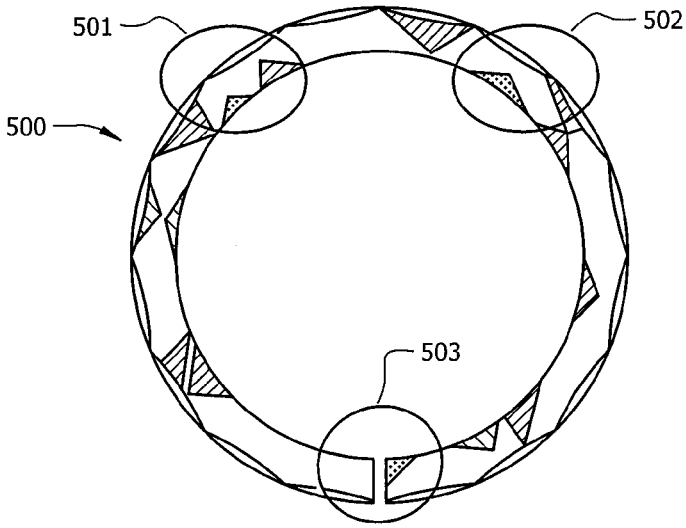
FIG. 5 is an illustration of an exemplary simulated RF circuit design adapted according to one embodiment of the invention.

FIG. 5 is an illustration of exemplary simulated RF circuit design 500 adapted according to one embodiment of the invention. Circuit design 500 provides a loop antenna of size $\lambda/50$, where $\lambda$ represents a wavelength. Antennas of very small size often suffer from very low efficiency. In the case of design 500, an all-copper antenna would have an efficiency of about 9%, which is ascertained by simulation. An example simulation program includes HFSS™, available from Ansoft, which is an industry standard simulation program for RF circuits and antennas. In this example, the simulation also displays the strength of the magnetic field at various points on antenna design 500. The areas marked 501, 502 and 503 have the highest magnetic field strength as well as the highest current densities of all areas on circuit design 500.

Figure 6:
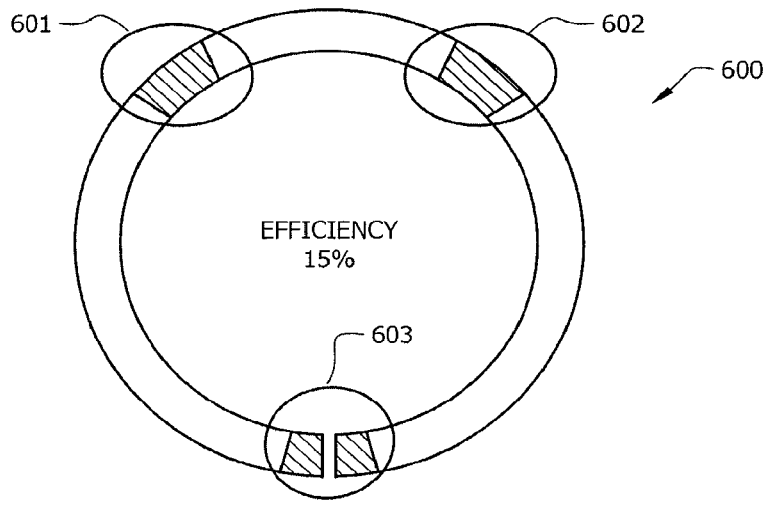
FIG. 6 is an illustration of an exemplary design according to one embodiment of the invention.

The simulation allows for the adjustments of parameters, such as materials, geometries, operating frequencies, and the like. In one example technique, the first simulation is performed with an all-conductor parameter space, and areas of high current density are ascertained, such as areas 501, 502 and 503. Next, the parameters of the design are changed to include a Perfect Electrical Conductor (PEC) at portions 601, 602, and 603 to approximate behavior of superconducting materials, as shown in circuit design 600 of FIG. 6. The simulation is run again, and there is a difference in the efficiency between an all-copper design and a design that replaces copper at portions with high current density. An all-copper design has a 9% efficiency; i.e., only 9% of the initial energy that goes in actually gets radiated outward. Circuit design 600 has a 15% efficiency, so the result of replacing some areas with superconductor produces almost a doubling in efficiency.

Figure 7:
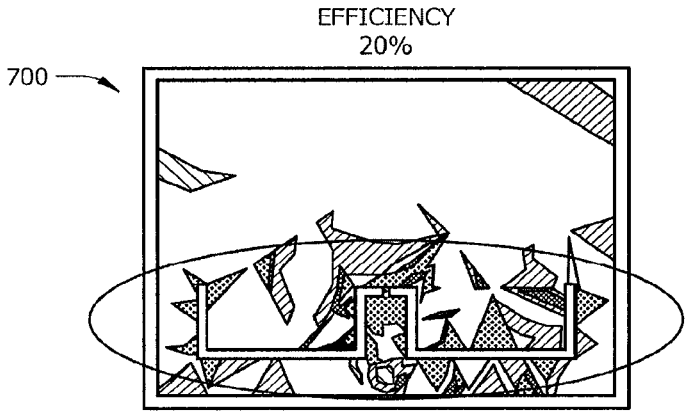
FIG. 7 is an illustration of an exemplary design according to one embodiment of the invention.
Figure 8:
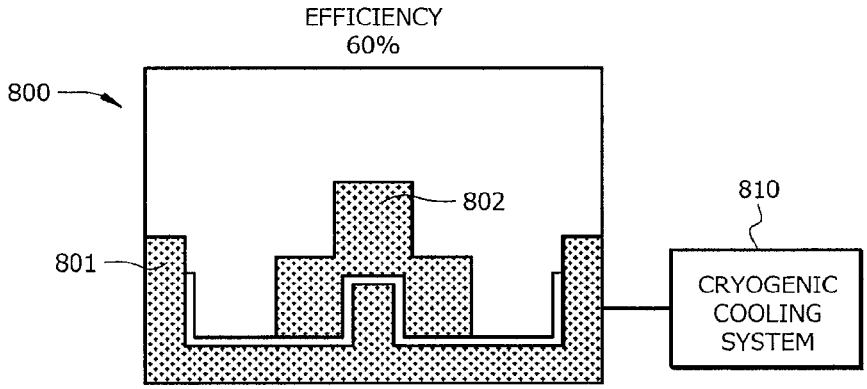
FIG. 8 shows an exemplary patch antenna with slot design according to one embodiment of the invention.

A loop antenna is only one example, as embodiments of the invention can employ any of a variety of RF circuit components with any geometry. Some geometries will give a large performance gain, whereas other geometries do not give much performance gain at all. For instance, a regular patch antenna that does not have any areas of inductive loading (and, therefore, lacks areas of very high current density) will typically not experience a large increase in efficiency by replacing high current density portions with superconducting portions. By contrast, a patch antenna with a slot may be expected to experience a large efficiency increase. FIG. 7 shows exemplary simulated patch antenna design 700 with a slot. In this simulation, the circled area shows areas with high current densities. The simulation also shows that all-copper design 700, sized at $\lambda/20$ has an efficiency of about 20%. FIG. 8 shows exemplary patch antenna with slot design 800, wherein portions 801 and 802 are PEC to approximate the effect of superconductor material. Simulation shows that design 800, sized at $\lambda/20$ has an efficiency of about 60%.

The examples above mention simulation as a way of ascertaining current density; however, embodiments of the invention can employ any technique for ascertaining current density. For instance, in one example a prototype is built out of non-superconducting material. Then, the magnetic field is probed using a metal instrument just above the surface of the prototype as the prototype radiates RF energy. The probe is connected to a network analyzer, which shows the areas with the highest magnetic field strength. Additionally or alternatively, a user can work through the mathematics by, e.g., using a general math computer program, such as MATLAB™.

Figure 9:
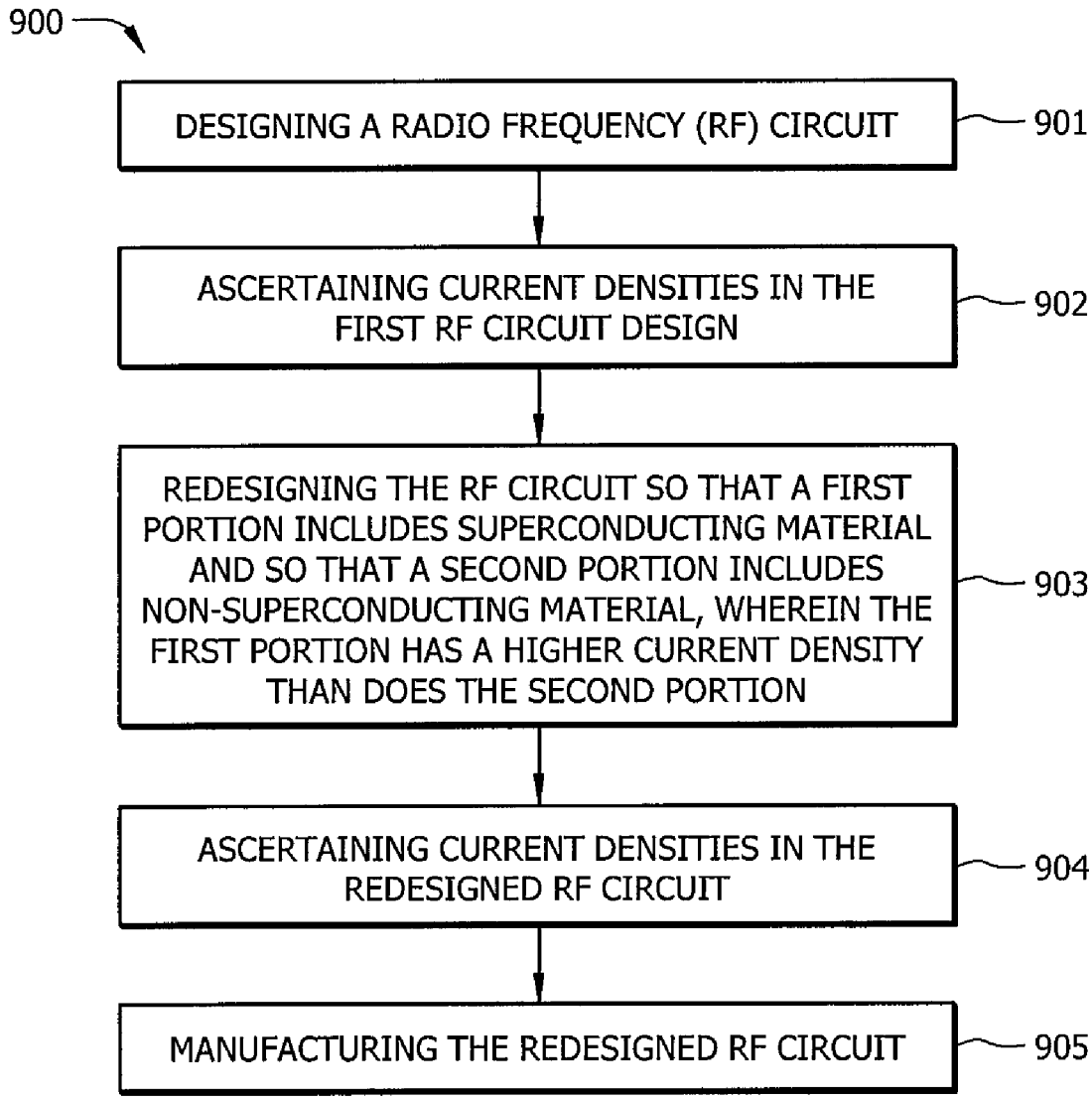
FIG. 9 is an illustration of an exemplary method adapted according to one embodiment of the invention.

Many techniques according to embodiments of the invention include methods for making RF circuits and components. FIG. 9 is an illustration of exemplary method 900 adapted according to one embodiment of the invention. Method 900 can be performed, for example, a person or group of persons creating and/or manufacturing RF designs.

In step 901, an RF circuit (or RF circuit component) is designed. The RF circuit or component can be any of a variety of RF current-carrying objects, such as an antenna, a filter, a divider, a coupler, a transmission line, or the like.

In step 902, current densities in a plurality of portions of the RF circuit are ascertained. In one example, operation is simulated with the RF circuit constructed of conducting (rather than superconducting) material. The simulation maps current density in the RF circuit and provides an indication of efficiency. Step 902 can also be performed by building a prototype and measuring magnetic field strength, analyzing mathematical models, and/or the like.

In step 903, the RF circuit is redesigned so that a first portion includes superconducting material and so that a second portion includes non-superconducting material, wherein the first portion has a higher current density than does the second portion. In other words, some conducting portions that have higher current densities than other portions are replaced with superconducting portions. Step 903 does not require that all high current density portions are replaced with superconducting material, only that one or more portions with higher current densities are replaced with superconducting material.

In step 904, current densities in the redesigned RF circuit are ascertained. Step 904 may also include ascertaining an indication of efficiency as well. Typically, efficiency in the redesigned circuit will be higher than in the original circuit without superconductor material.

In step 905, the redesigned RF circuit is manufactured. The RF circuit can be manufactured using of any of a variety of conductors (e.g., copper, aluminum, etc.) and superconductors (e.g., YBCO, Bismuth Strontium Calcium Copper Oxide (BSCCO), etc.). In some embodiments, cold copper is used instead of superconducting material. Cold copper is copper that is cooled to 2-3° K, and it has similar properties as superconducting ceramic materials. Cold copper embodiments include, but are not limited to, embodiments wherein a component is made entirely of copper and some or all of the copper is cooled using a cryogen, as explained below.

One manufacturing technique includes building the circuit on a film substrate, such as a film substrate that comes with superconducting material. An example of such a film includes flexible PCB, hard PCB (e.g., FR4), fluoropolymers (e.g., TEFLON™), and the like. Other substrates can be used as well (e.g., LaAlO), especially those that do not crack or deform when exposed to very low temperatures.

Various embodiments also include a cryogenic cooling system with the circuit during manufacture and/or deployment. When using high temperature superconducting materials, liquid nitrogen can often be used to provide cooling. With low-temperature superconducting materials, embodiments may use liquid helium or other very low temperature liquids. According to some embodiments, cryogenic cooling systems may provide for cooling very large portions of the device or may focus on small areas where the superconducting material is located (i.e., spot cooling).

While method 900 is shown as a series of discrete steps, some embodiments of the invention are not limited thereto. Rather, embodiments may add, omit, rearrange, and/or modify steps. For instance, some embodiments may omit step 904. Alternatively, other embodiments may use step 904 to provide feedback and to make iterative design modifications to optimize (or at least noticeably improve) performance of the circuit design. In some embodiments, steps 901-904 are performed by a Research and Development (R&D) group, whereas step 905 is performed by a manufacturing group different from the R&D group.

Embodiments of the invention may include one more advantages over the prior art. For instance, some prior art systems include constructing the entire system from superconducting material. Such prior art systems are very expensive. Furthermore, superconducting materials have limitations in the shapes that they can take. For example, superconducting materials are usually formed in long, narrow wires and are typically not ductile and, therefore, are limited to two-dimensional structures based on long and narrow shapes. Other prior art solutions mix superconducting components and conducting components, e.g., in a bank of filters making some filters out of superconducting materials and other filters out of conducting materials. Once again, such systems are expensive. Furthermore, the discrete components made out of superconducting material are limited to two-dimensional shapes.

By contrast, some embodiments of the present invention treat a component itself on the component level and address the portions of the component that benefit the most from using superconducting material. By mixing materials within a discrete component, some embodiments save costs by minimizing the amount of superconducting material used. Also, more complex shapes, including three-dimensional shapes, can be made by manipulating the conducting portions. Further, embodiments of the invention offer increased performance over traditional, all-copper antennas, especially for very small or loaded antennas.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. An antenna element comprising:

a non-superconducting material; and a superconducting material, wherein the superconducting material is disposed in one or more areas of the antenna element predetermined to have a high current density if the one or more areas of the antenna element were to be made from a non-superconducting material such that the areas with superconducting material conduct greater current density than do areas with the non-superconducting material.

2. The antenna element of claim 1 further comprising a cryogenic cooling system providing cooling to said superconducting material.

3. The antenna element of claim 1 wherein said antenna element comprises a slot, and said superconducting material is disposed to at least partly surround said slot.

4. The antenna element of claim 1 wherein said component is configured as a three-dimensional shape.

5. The antenna element of claim 1 wherein said superconducting material is coupled to said non-superconducting material using capacitive coupling.

6. A method for creating a circuit, said method comprising:

designing a Radio Frequency (RF) component;

ascertaining current densities in said RF component design; and modifying said designed RF component using said ascertained current densities so that a first portion of said RF component includes material with superconducting properties and so that a second portion of said RF component includes non-superconducting material, wherein said first portion of said RF component was determined to have a higher current density by said ascertaining than does said second portion.

7. A Radio Frequency (RF) circuit comprising:

a current path including a first portion that has a higher current density than does a second portion of said current path;

wherein said first portion comprises superconducting material, and said second portion includes non-superconducting material.

8. The RF circuit of claim 7 wherein said RF circuit comprises an antenna element.

9. The RF circuit of claim 7 further comprising:

a cryogenic system providing spot cooling to said first portion.

10. The RF circuit of claim 7 wherein the RF circuit operates within the frequency range of one megahertz to ten terahertz.

11. The RF circuit of claim 7 wherein the RF circuit is substantially planar in shape.

12. The RF circuit of claim 7 wherein the RF circuit is three-dimensional in shape.

13. A method for creating a circuit, said method comprising:

designing a Radio Frequency (RF) component;

ascertaining current densities in said RF component design; and modifying said designed RF component using said ascertained current densities so that a first portion of said RF component includes superconducting material and so that a second portion of said RF component includes non-superconducting material, wherein said first portion of said RF component was determined to have a higher current density by said ascertaining than does said second portion of said RF component.

14. The method of claim 13 further comprising:

ascertaining current densities in said modified, designed RF component.

15. The method of claim 14 further comprising:

using said ascertained current densities in said modified, designed RF component to further modify said RF component design.

16. The method of claim 13 wherein ascertaining current densities comprises:

running a simulation of said RF component.

17. The method of claim 16 wherein said simulation does not include simulation of superconducting material as part of said simulation of said RF component.

18. The method of claim 13 further comprising:

ascertaining current densities in said modified, designed RF component through simulation, wherein said simulation uses a perfect electrical conductor for said first portion.

19. The method of claim 13 further comprising:

manufacturing said modified, designed RF component.

20. A Radio Frequency (RF) component comprising:

a non-superconducting material; and a material with superconducting properties, wherein the material with superconducting properties is disposed in one or more areas of the RF component predetermined to have a high current density if the one or more areas of the RF component were to be made from a non-superconducting material such that the areas with the material with superconducting properties conduct greater current density than do areas with the non-superconducting material.

21. The RF component of claim 20 wherein said RF component comprises an antenna element.

22. The RF component of claim 20 wherein said non-superconducting material comprises:

copper.

23. The RF component of claim 20 wherein said material with superconducting properties comprises:

cold copper.

24. The RF component of claim 20 wherein said material with superconducting properties comprises:

YBCO.

* * * * *

UNITED STATES PATENT AND TRADEMARK OFFICE

CERTIFICATE OF CORRECTION

PATENT NO. : 8,238,989 B2
APPLICATION NO. : 12/200902
DATED : August 7, 2012
INVENTOR(S) : Corbett R. Rowell It is certified that error appears in the above-identified patent and that said Letters Patent is hereby corrected as shown below:

Column 3, Line 36, delete the portion of text reading "any conducting material" and replace with --any non-superconducting material--.

Column 3, Line 38, delete the portion of text reading "(YBCO)," and replace with --(YBCO) as the superconducting material,--.

Signed and Sealed this
Eleventh Day of September, 2012

David J. Kappos

David J. Kappos
*Director of the United States Patent and Trademark Office*

UNITED STATES PATENT AND TRADEMARK OFFICE

CERTIFICATE OF CORRECTION

PATENT NO. : 8,238,989 B2
APPLICATION NO. : 12/200902
DATED : August 7, 2012
INVENTOR(S) : Corbett R. Rowell It is certified that error appears in the above-identified patent and that said Letters Patent is hereby corrected as shown below:

In the Specification:

Column 3, Line 41, delete the portion of text reading "conducting material" and replace with --non-superconducting material--.

Column 5, Line 48, delete the portion of text reading "system with" and replace with --system (e.g., cryogenic cooling system 810 of Figure 8) with--.

Signed and Sealed this
Ninth Day of September, 2014

Michelle K. Lee

Michelle K. Lee
*Deputy Director of the United States Patent and Trademark Office*